US009440281B2

(12) United States Patent
Hirata

(10) Patent No.: US 9,440,281 B2
(45) Date of Patent: Sep. 13, 2016

(54) DEVICE AND METHOD FOR MANUFACTURING WORK

(75) Inventor: Kazuyuki Hirata, Toyota (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 1216 days.

(21) Appl. No.: 12/885,811

(22) Filed: Sep. 20, 2010

(65) Prior Publication Data

US 2011/0079122 A1 Apr. 7, 2011

(30) Foreign Application Priority Data

Oct. 2, 2009 (JP) ..... 2009-230996

(51) Int. Cl.

| | |
|---|---|
| ***B21D 45/02*** | (2006.01) |
| ***B21D 45/04*** | (2006.01) |
| ***B26D 5/16*** | (2006.01) |
| ***B26D 7/18*** | (2006.01) |
| ***B21D 45/00*** | (2006.01) |

(52) U.S. Cl.

CPC ..... *B21D 45/003* (2013.01); *B21D 45/02* (2013.01); *B21D 45/04* (2013.01); *B26D 5/16* (2013.01); *B26D 7/1818* (2013.01); *Y10T 83/0448* (2015.04); *Y10T 83/2096* (2015.04)

(58) Field of Classification Search

CPC .... B21D 45/003; B21D 45/02; B21D 45/04; B21D 45/10; B26D 5/16; B26D 7/1818; Y10T 83/0448; Y10T 83/2096; Y10T 83/2122; Y10T 83/2124; Y10T 83/2127; Y10T 83/2131; Y10T 83/2133; Y10T 83/2135; Y10T 83/214

USPC ..... 83/124, 125, 128, 129, 131, 127, 23, 83/111, 223; 72/328, 344, 345

See application file for complete search history.

(56) References Cited

U.S. PATENT DOCUMENTS

| | | | |
|---|---|---|---|
| 6,305,209 | B1 | 10/2001 | Suzuki et al. |
| 2009/0301161 | A1 | 12/2009 | Fujimura et al. |

FOREIGN PATENT DOCUMENTS

| | | |
|---|---|---|
| DE | 28 31 775 | 1/1980 |
| EP | 1 043 093 | 10/2000 |
| EP | 1520638 | 4/2005 |
| JP | 47-036271 | 11/1972 |
| JP | 62-202918 U | 12/1987 |

(Continued)

OTHER PUBLICATIONS

Germany Office action, dated Jul. 31, 2013 along with an english translation thereof.

(Continued)

*Primary Examiner* — Clark F Dexter

(74) *Attorney, Agent, or Firm* — Greenblum & Bernstein, P.L.C.

(57) ABSTRACT

An upper die unit and a lower die unit are provided. One of the upper and lower die units includes a main punch and the other die unit includes an ejector, a slider and a biasing portion which is connected to the slider and biases the slider in a predetermined sliding direction S. A cam structure is disposed between the slider and the ejector and converts a movement of the ejector to a movement of the slider in a direction opposite to a predetermined sliding direction when the upper and lower die units are closed, and converts a movement of the slider to a movement of the ejector in a work ejecting direction when the upper and lower die units are opened. A position retaining portion is also provided which retains a position of the slider for a period of time.

9 Claims, 7 Drawing Sheets

(56) References Cited

FOREIGN PATENT DOCUMENTS

| | | |
|---|---|---|
| JP | 3-57524 | 3/1991 |
| JP | 6-31695 | 2/1994 |
| JP | 2000-280033 | 10/2000 |
| JP | 2001-121220 | 5/2001 |
| JP | 2002-336917 | 11/2002 |
| JP | 2008-142772 | 6/2008 |
| KR | 20090010708 | 1/2009 |
| WO | 2008/059989 | 5/2008 |

OTHER PUBLICATIONS

Japan Office action, dated Apr. 16, 2013 along with an english translation thereof.

China Office action, dated Sep. 12, 2012 along with an english translation thereof.

DEVICE AND METHOD FOR MANUFACTURING WORK

CROSS-REFERENCE TO RELATED APPLICATIONS

The present application claims priority under 35 U.S.C. §119 of Japanese Application No. 2009-230996 filed on Oct. 2, 2009, the disclosure of which is expressly incorporated by reference herein in its entirety.

BACKGROUND OF THE INVENTION

1. Field of the Invention

The present invention relates to a device and a method for manufacturing a work. More specifically, the present invention relates to a device and a method for manufacturing a work which can prevent a work punched out by a main punch from being pushed back to a material to be processed side at the same time of a die opening operation, prevent the size of a die structure from increasing in the height direction, and allows an easy replacement/inspection of a biasing portion which is a driving source of an ejector.

2. Description of Related Art

Generally, a conventional pressing machine including an upper die unit and a lower die unit, one of them having a main punch and the other having an ejector that can move up and down, a biasing portion that biases the ejector in a work ejecting direction, and a position retaining portion that retains the position of the ejector which is moved against a biasing force of the biasing portion for a certain period of time is known (refer to Related Arts 1 and 2, for example). In such a known pressing machine, when the upper die unit and the lower die unit are opened from a closed state by a predetermined amount, the position retaining portion releases the ejector retained in a position and the work is punched out by the main punch and retained on the other die unit side by a frictional force is discharged by the ejector. Thus, the work punched out by the main punch is prevented from being pushed back to and interfering with a material to be processed (which is also called "push-back") when the die units are opened.

Related Arts 1 above discloses a pressing machine, as shown in FIGS. 7 and 8, including: a lower die unit 100 having a main punch 101; an upper die unit 102 having an ejector 103 that can move up and down and an elastic member 104 connected to the ejector 103 at the top end thereof that biases the ejector 103 downward; and a position retaining portion 109 for retaining the ejector 103 in a position for a certain period of time. The position retaining portion 109 includes an ejector block 105 having one end portion engageable with the ejector 103 and being movable in a horizontal direction, a backup block 106 which is engaged with the ejector block 105 and can move up and down, and an elastic member 107 which biases the backup block 106 upward. When the upper die unit 102 and the lower die unit 100 are closed (see FIG. 7), a work W is punched out from a material to be processed M by the main punch 101. When the upper die unit and the lower die unit are opened (see FIG. 8), the ejector 103 retained by the position retaining portion 109 is released, the ejector 103 is moved down by a biasing force of the elastic member 104, and the work is discharged by the ejector 103.

Related Art 2 above discloses a pressing machine, as shown in FIGS. 9 and 10, including: an upper die unit 110 having a forming punch 111 (main punch); a lower die unit 112 having a counter punch 113 (ejector) that can move up and down and a biasing portion 114 which is communicated to the bottom side of the counter punch 113 and which biases the counter punch 113 upward; and a position retaining portion 119 for retaining the counter punch 113 in the position for a certain period of time. The position retaining portion 119 has a pusher member 115 disposed to the counter punch 113 so as to move up and down, a slider 116 which is horizontally movable, a spring member 117 which biases the slider 116 and a cam structure 118 (cam and follower) which is provided between the pusher member 115 and the slider 116 and which moves the pusher member 115 upward in an engaged state and retains it in a descended position in a non-engaged state. When the upper die unit 110 and the lower die unit 112 are closed (see FIG. 9), the main punch 111 punches a work W from a material to be processed M. When the upper die unit and the lower die unit are opened (see FIG. 10), the counter punch 113 retained by the position retaining portion 119 is released, the counter punch 113 is moved upward by a biasing force of the biasing portion 114, and the work is discharged by the counter punch 113.

[Related Art 1] Japanese Patent Laid-open Publication No. 2008-142772

[Related Art 2] Japanese Patent Laid-open Publication No. 2001-121220

However, in Related Arts 1 and 2, the biasing portion (the elastic member 104 of Related Arts 1, the biasing portion 114 of Related Arts 2) as a driving source of the ejector that discharges a work is disposed along a direction in which the ejector moves up and down, resulting in an increase of the size of a die structure in a height direction. Especially, when there is a dimensional restriction in a height direction of a die structure, a biasing portion having a smaller dimension of height (that is, a smaller biasing force) must be adopted in some cases, leading to a low flexibility in selection of a biasing portion. Further, in a case where a biasing portion is changed according to the material, shape and size of a work or a biasing portion is inspected for damage or the like, the upper die unit or the lower die unit needs to be removed from the pressing machine. This complicates replacement or inspection of a biasing portion.

SUMMARY OF THE INVENTION

The embodiments of the present invention are provided to address the problems with the conventional technology above. An advantage of the embodiments of the present invention is to provide a device and a method for manufacturing a work, which can prevent a work punched out by a main punch from being pushed back to a material to be processed side at the same time of the die opening operation, prevent the size of a die structure from increasing in a height direction, and allows an easy replacement or inspection of a biasing portion that is a driving source of an ejector.

One aspect of the present embodiments provides a work manufacturing device including an upper die unit; and a lower die unit disposed opposite to the upper die unit, wherein one of the upper die unit and the lower die unit includes a main punch for punching out a work from a material to be processed, and the other die unit includes: an ejector disposed so as to be movable in a vertical direction and to discharge the work punched out by the main punch and retained on the other die unit side; a slider disposed so as to be movable in a direction crossing with a vertical direction; and a biasing portion connected to the slider and biasing the slider in a predetermined sliding direction (S), and a cam structure is disposed between the slider and the ejector, which converts a movement of the ejector in a direction opposite to a work ejecting direction (E) to a movement of the slider in a direction opposite to the predetermined sliding direction (S) when the upper die unit and the lower die unit are closed, and which converts a movement of the slider in the predetermined sliding direction (S) to a movement of the ejector in the work ejecting direction (E) when the upper die unit and the lower die unit are opened by a predetermined amount from the closed state, the device further comprising a position retaining portion which retains the slider moved in a direction opposite to the predetermined sliding direction (S), in the position for a certain period of time.

In a further aspect, a biasing portion for buffering that biases the slider in a direction opposite to the predetermined sliding direction (S) is connected to one end of the slider in the predetermined sliding direction (S).

In a further aspect, the cam structure includes: a cam face disposed in the slider and inclined in the predetermined sliding direction (S) of the slider; and a roller which is rotatably disposed in the ejector so as to roll on the cam face.

In a further aspect, the position retaining portion includes: a restriction member provided in the other die unit so as to be movable between a control state (C1) in which a movement of the slider in the predetermined sliding direction (S) is restricted and a non-control state (C2) in which a movement of the slider in the predetermined sliding direction (S) is derestricted; a biasing portion for restriction which biases the restriction member toward the control state (C1); and a derestriction member which moves the restriction member against a biasing force of the biasing portion for restriction from the control state (C1) to the non-control state (C2) when the upper die unit and the lower die unit are opened by a predetermined amount from the closed state.

In a further aspect, the one die unit is a lower die unit and the other die unit is an upper die unit.

One aspect of the present embodiments provides a method for manufacturing a work using the work manufacturing device above, including the steps of: converting by the cam structure a movement of the ejector in a direction opposite to the work ejecting direction (E) to a movement of the slider in a direction opposite to the predetermined sliding direction (S) against a biasing force of the biasing portion when the upper die unit and the lower die unit are closed to punch out the work from the material to be processed by the main punch, and retaining the moved slider by the position retaining portion; and opening the upper die unit and the lower die unit by a predetermined amount from the closed state to release the slider retained by the position retaining portion, converting by the cam structure a movement of the slider in the predetermined sliding direction (S) by a biasing force of the biasing portion to a movement of the ejector in the work ejecting direction (E), and discharging the work punched out by the main punch and retained to the other die unit side by a friction force.

In the work manufacturing device according to the present embodiments, when an upper die unit and a lower die unit are closed, a work is punched out from a material to be processed by a main punch, the work is retained to the other die unit side by a friction force, an ejector is moved in a direction opposite to a work ejecting direction (E), a cam structure converts the movement of the ejector to a movement of a slider in a direction opposite to a predetermined sliding direction (S) against a biasing force of a biasing portion, and the slider that was moved is retained by a position retaining portion. When the upper die unit and the lower die unit are opened by a predetermined amount from the closed state, the slider retained by the position retaining portion is released, the cam structure converts the movement of the slider in the predetermined sliding direction (S) by a biasing force of the biasing portion to a movement of the ejector in a work ejecting direction (E), and the ejector discharges the work punched out by the main punch and retained to the other die unit side by a friction force. Thus, since the ejector discharges a work when the upper die unit and the lower die unit are opened by a predetermined amount from a closed state, the work punched out by the main punch is prevented from being pushed back to the material to be processed side at the same time of the die opening operation. Also, the cam structure converts a movement of the slider in a direction crossing with a vertical direction to a movement of the ejector in a vertical direction and vice versa, so that a biasing portion as a driving source of the ejector can be disposed along a direction crossing with a vertical direction. As a result, the size of a die structure is prevented from increasing in a height direction. Especially, even if there is a dimensional restriction in a height direction of a die structure, a biasing portion which has a larger dimension of height (that is, a larger biasing force) can be adopted, leading to a higher flexibility in selection of a biasing portion. In addition, a biasing portion can be disposed on a lateral side end of a die unit. As a result, the biasing portion can be easily replaced or inspected without removing an upper die unit or a lower die unit from the device.

In addition, in a case where a biasing portion for buffering is connected to one side of the slider in the predetermined sliding direction (S), the biasing portion for buffering can buffer a shock at the slider moving end when the work is discharged. Therefore, a reliable operation is ensured even if the work ejecting speed is increased. Also, the biasing portion for buffering of the slider can be disposed along a direction crossing with a vertical direction. Therefore, the size of a die structure is prevented from increasing in a height direction thereof.

In a case where the cam structure has a cam face disposed in the slider and inclined in the predetermined sliding direction (S) of the slider and a roller which is rotatably disposed in the ejector so as to roll on the cam face, the roller of the ejector rolls over the cam face of the slider, so that a movement of the slider in a direction crossing with a vertical direction can be converted more smoothly to a movement of the ejector in a vertical direction and vice versa.

In a case where the position retaining portion has a restriction member, a biasing portion for restriction and a derestriction member, the restriction member in a control state (C1) restricts a movement of the slider in a predetermined sliding direction (S) until just before the upper die unit and the lower die unit are opened by a predetermined amount from a closed state. In addition, when the upper die unit and the lower die unit are opened by a predetermined amount, the derestriction member moves the restriction member from the control state (C1) to a non-control state (C2) to derestrict a movement of the slider in a predetermined sliding direction (S). This allows the slider and the ejector to be retained in a position and released from the position more reliably.

Further, in a case where one of the die units is a lower die unit and the other die unit is an upper die unit, a work punched out by a main punch is retained on the upper die unit side when the upper die unit and the lower die unit are closed, and the work drops down and is discharged by the ejector when the upper die unit and the lower die unit are opened by a predetermined amount from a closed state. Therefore, compared to a device in which the work retained on the lower die unit side is lifted up to discharge, the device of the present invention enhances production efficiency of a work. In addition, a relatively large space between the upper die unit and the lower die unit, in which a work does not interfere with a material to be processed, can be used as a work ejecting space.

In the method for manufacturing a work according to the present embodiments, when the upper die unit and the lower die unit are closed, a work is punched out from a material to be processed by a main punch, the work is retained on the other die unit side by a friction force, the ejector is moved in a direction opposite to a work ejecting direction (E). Then, the cam structure converts the movement of the ejector to a movement of the slider in a direction opposite to a predetermined sliding direction (S) against a biasing force of the biasing portion, and the slider moved is retained in a position by the position retaining portion. When the upper die unit and the lower die unit are opened by a predetermined amount from the closed state, the slider retained by the position retaining portion is released, the cam structure converts the movement of the slider in a predetermined sliding direction (S) by a biasing force of the biasing portion to a movement of the ejector in a work ejecting direction (E), and the ejector discharges the work punched out by the main punch and retained by a friction force on the other die unit side. Thus, when the upper die unit and the lower die unit are opened by a predetermined amount from a closed state, the ejector discharges a work. Therefore, a work punched out by the main punch is prevented from being pushed back toward a material to be processed side at the same time of the die opening operation. In addition, the cam structure converts a movement of the slider in a direction crossing with a vertical direction to a movement of the ejector in a vertical direction and vice versa. Therefore, the biasing portion as a driving source of the ejector can be disposed along a direction crossing with a vertical direction, and the size of a die unit structure is prevented from increasing in a height direction. Especially, in a case where there is a dimensional restriction in a height direction of a die structure, a biasing portion which has a larger dimension of height (that is, a larger biasing force) can be adopted, leading to a higher flexibility in selection of a biasing portion. Further, a biasing portion can be disposed on a lateral side end of a die unit. In this configuration, the biasing portion can be easily replaced or inspected without removing an upper die unit or a lower die unit from the device.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIGS. 3A and 3B are enlarged views of the essential parts of the pressing machine shown in FIG. 1, wherein FIG. 3A illustrates a state in which the die units are closed and the ejector is elevated; and FIG. 3B illustrates a state in which the die units are opened and the ejector is lowered;

DETAILED DESCRIPTION OF PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The work manufacturing device according to the present embodiments includes: an upper die unit; a lower die unit opposite to the upper die unit; wherein one of the upper die unit and the lower die unit has a main punch for punching out a work from a material to be processed, the other die unit has an ejector disposed so as to be movable in a vertical direction and to discharge the work punched out by the main punch and retained on the other die unit side, a slider disposed so as to be movable in a direction crossing with a vertical direction, a biasing portion connected to the slider and biasing the slider in a predetermined sliding direction (S), and a cam structure is disposed between the slider and the ejector, which converts a movement of the ejector in a direction opposite to a work ejecting direction (E) to a movement of the slider in a direction opposite to the predetermined sliding direction (S) when the upper die unit and the lower die unit are closed (see FIG. 4, as an example), and which converts a movement of the slider in the predetermined sliding direction (S) to a movement of the ejector in the work ejecting direction (E) when the upper die unit and the lower die unit are opened by a predetermined amount from the closed state (see FIG. 6, as an example); and the device further comprising a position retaining portion, wherein the position retaining portion retains the slider, and was moved in a direction opposite to the predetermined sliding direction (S), in the position for a certain period of time.

Figure 5:
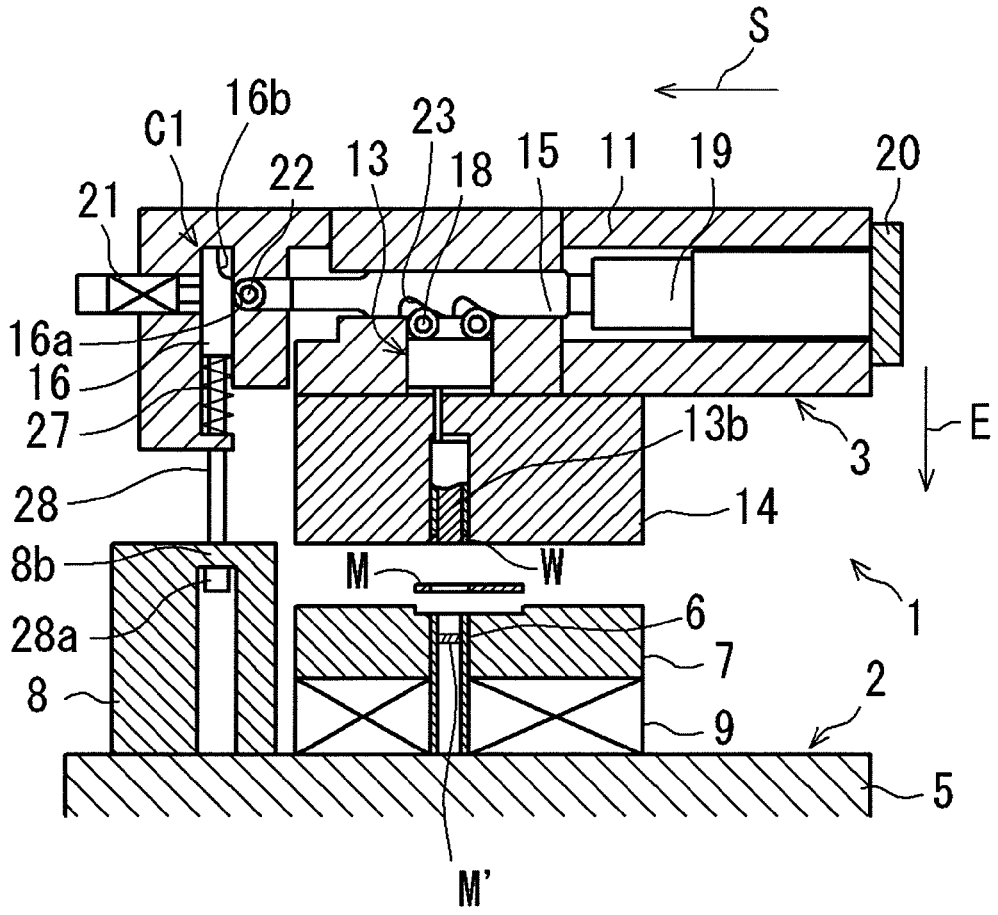
FIG. 5 is an operational view of the pressing machine shown in FIG. 1, illustrating a state in which the die units are half closed/opened.
Figure 6:
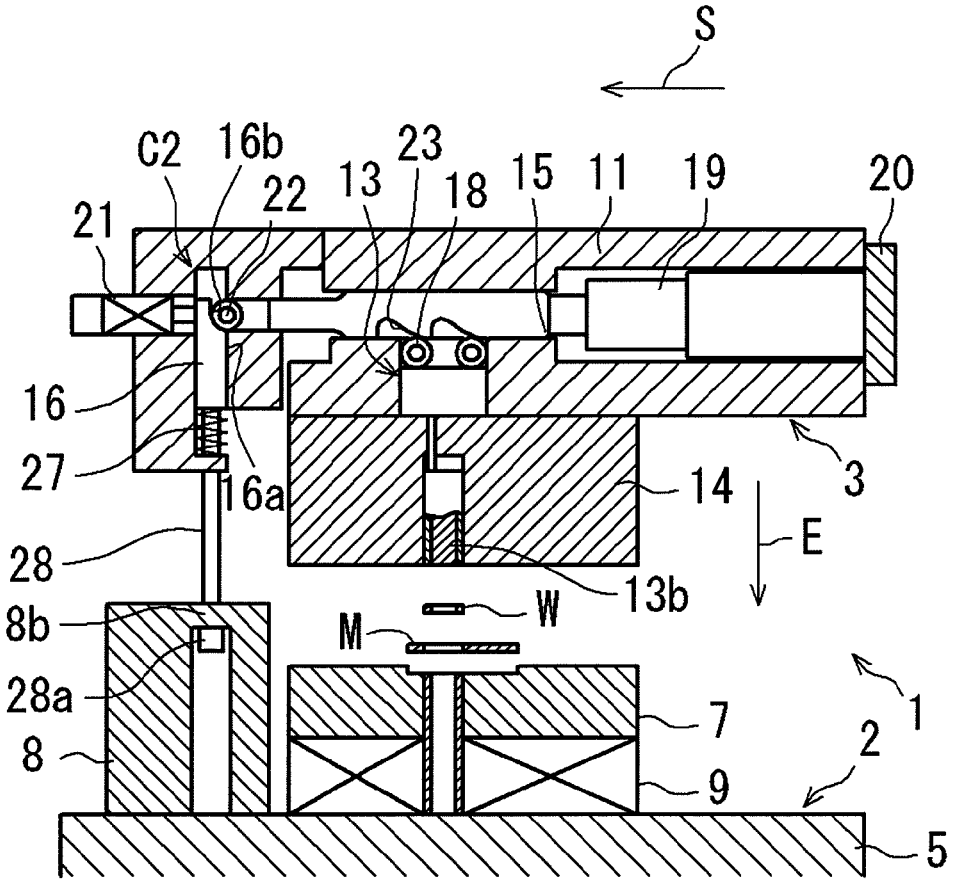
FIG. 6 is an operational view of the pressing machine shown in FIG. 1, illustrating a state in which the die units are opened (a top dead center)
Figure 7:
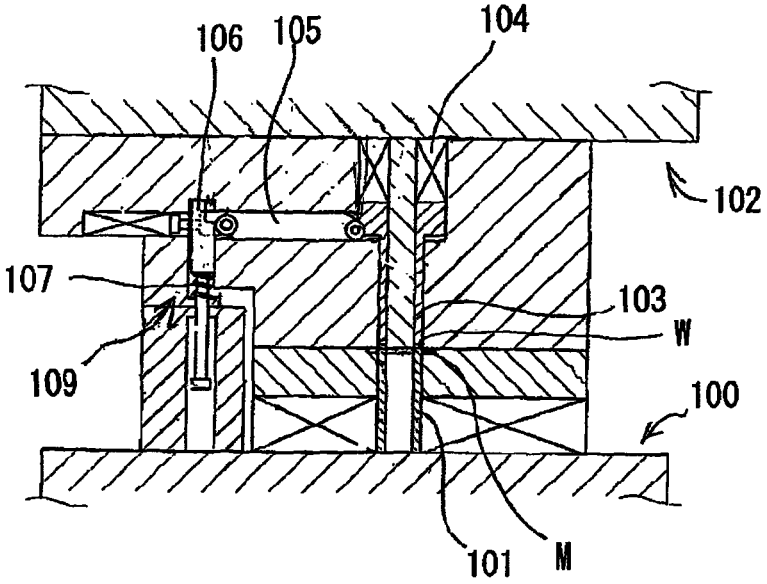
Fig.7 Prior Art
FIG. 7 is a longitudinal sectional view of a conventional pressing machine, illustrating a state in which the die units are closed.
Figure 8:
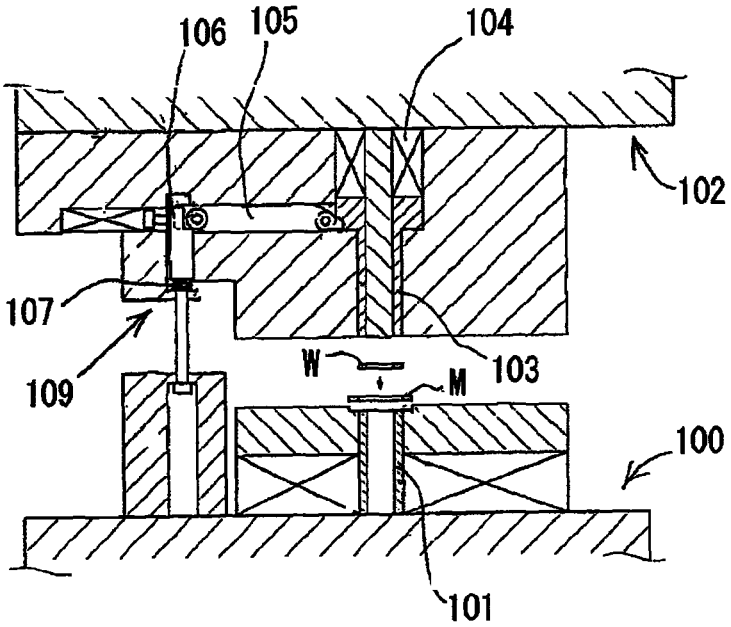
Fig.8 Prior Art
FIG. 8 is a longitudinal sectional view of the conventional pressing machine shown in FIG. 7, illustrating a state in which the die units are opened.
Figure 9:
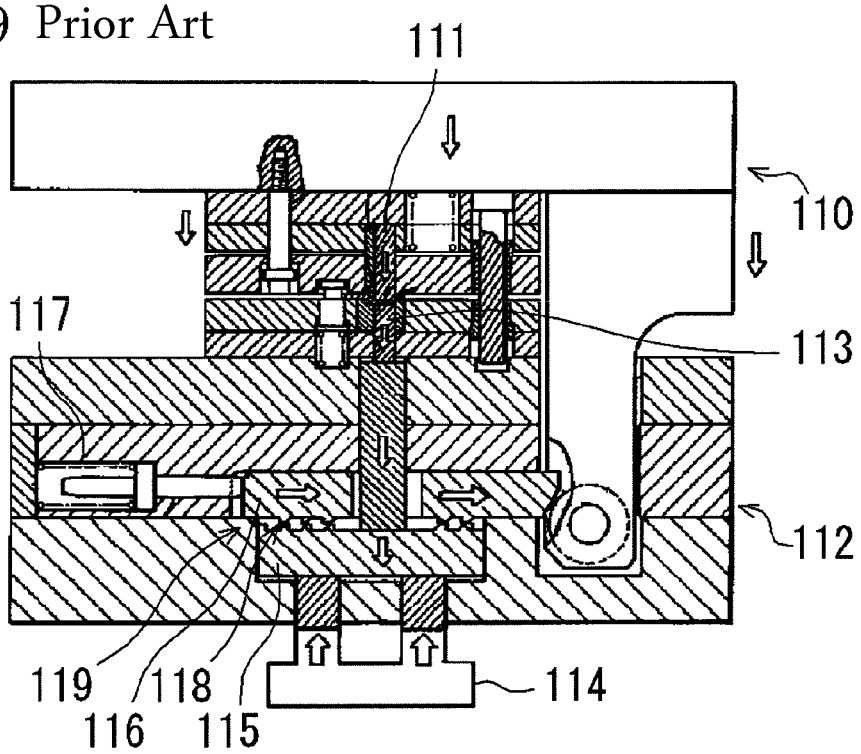
Fig.9 Prior Art
FIG. 9 is a longitudinal sectional view of another conventional pressing machine, illustrating a state in which the die units are closed.
Figure 10:
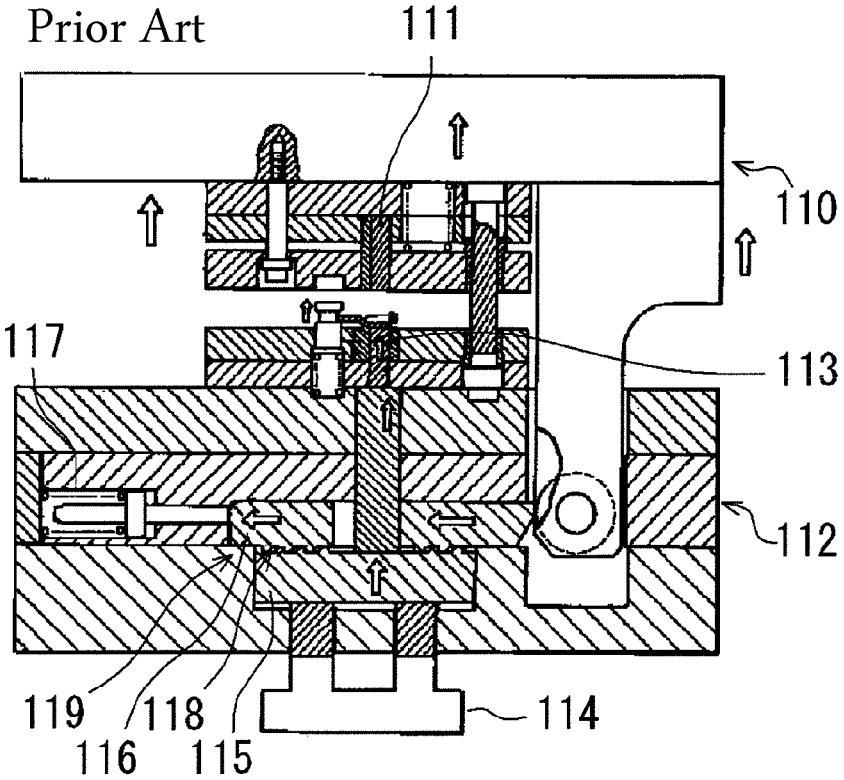
Fig.10 Prior Art
FIG. 10 is a longitudinal sectional view of the conventional pressing machine shown in FIG. 9, illustrating a state in which the die units are opened.

In the above description, the state referred to as "when the upper die unit and the lower die unit are opened by a predetermined amount from the closed state" may be a state in which the upper die unit and the lower die unit are half closed and opened (see FIG. 5, as an example) or a state in which the upper die unit and the lower die unit are fully opened (see FIG. 6, as an example). The above-described "a certain period of time" intends to refer to a period until just before the upper die unit and the lower die unit are opened by a predetermined amount from a closed state so that the slider retained by the position retaining portion is released when the upper die unit and the lower die unit are opened by a predetermined amount from the closed state. Further, one example of the above-mentioned "work" is a member (such as a cam member having a through-hole) that forms a reclining mechanism for automobile seats.

The "main punch" may have any structure, shape and size. The main punch generally punches out a predetermined shape of work from a material to be processed when the upper die unit and lower die unit are closed, and the punched-out work is retained on the other die unit by a friction force.

The "ejector" may have any structure, shape and size. When the upper die unit and the lower die unit are closed, the ejector is generally moved in a direction opposite to a work ejecting direction (E) by the work that is retained on the other die unit side. When the upper die unit and the lower die unit are opened by a predetermined amount from the closed state, the ejector is moved in a work ejecting direction (E) by a biasing force of the biasing portion conveyed via the cam structure to discharge the work that is retained on the other die unit side.

The "slider" may have any structure, shape and size. A biasing portion for buffering which biases the slider in a direction opposite to a predetermined sliding direction (S) may be connected at one side of the slider in the predetermined sliding direction (S). The biasing portion for buffering may be disposed so as to apply a biasing force along a moving direction of the slider. Examples of the biasing portion for buffering include a gas spring, a spring member and a fluid cylinder.

The "biasing portion" may have any structure and biasing form. The biasing portion generally functions as a driving source of the ejector. The biasing portion may, for example, be connected to one end of the slider opposite to a predetermined sliding direction (S). The biasing portion may, for example, be disposed so as to apply a force along a moving direction of the slider. Examples of the biasing portion include a gas spring, a spring member and a fluid cylinder.

The "cam structure" may have any structure and conversion form. As one example, the cam structure may have cam faces which are disposed in the slider and inclined in a predetermined sliding direction (S) of the slider and rollers which are rotatably disposed in the ejector so as to roll on the cam faces (see FIG. 3, as an example). The inclination angle θ of the cam faces (see FIG. 3) may be 15 to 75 degrees (preferably, 30 to 60 degrees). When the inclination angle θ is less than 45 degrees, even a small force applied by the biasing portion can be converted to a downward force. On the other hand, when the inclination angle θ is more than 45 degrees, only a small amount of movement in a sliding direction is required for conversion. An appropriate inclination angle θ may be set depending on the purpose.

The "position retaining portion" may have any structure and position retaining form. As one example, the position retaining portion may include a restriction member provided on the other die unit so as to move between a control state (C1) in which a movement of the slider in a predetermined sliding direction (S) is restricted and a non-control state (C2) in which a movement of the slider in the predetermined sliding direction (S) is derestricted, a biasing portion for restriction which biases the restriction member toward the control state (C1) and a derestriction member which moves the restriction member against a biasing force of the biasing portion for restriction from the control state (C1) to the non-control state (C2) when the upper die unit and the lower die unit are opened by a predetermined amount from a closed state. This restriction member may have a restriction face that comes into contact with one end of the slider to restrict a movement of the slider in a predetermined sliding direction (S) and a notch into which one end of the slider gets to allow a movement of the slider in a predetermined sliding direction (S). Examples of the above-mentioned biasing portion for restriction include a gas spring, a spring member and a fluid cylinder. The above-mentioned derestriction member may be a guide which is disposed to one of the die units and engaged with the restriction member to restrict a moving range of the restriction member.

The work manufacturing device according to the embodiments may have a form in which one of the die units may be a lower die unit and the other die unit is an upper die unit. In this form, the lower die unit may include a lower base, a stripper which is attached to the lower base so as to be movable in a vertical direction and on which a material to be processed is placed, a stripper biasing portion which biases the stripper upward, and the main punch integrally formed with the lower base. Therefore, when the upper die unit and the lower die unit are closed, a work is punched out from a material to be processed by the main punch along with a relative movement of the stripper and the main punch. In the above-mentioned form, the lower die unit may include a subsidiary punch which is internally engaged in the ejector. Therefore, when the upper die unit and the lower die unit are closed, a work is punched out from a material to be processed by the main punch and scraps are punched out from the punched work by the subsidiary punch. Consequently, production efficiency of a work is further enhanced.

The work manufacturing method according to the present embodiments is a work manufacturing method using the work manufacturing device above, including the steps of: [A] converting by the cam structure a movement of the ejector in a direction opposite to a work ejecting direction (E) to a movement of the slider in a direction opposite to a predetermined sliding direction (S) against a biasing force of the biasing portion when the upper die unit and the lower die unit are closed to punch out a work from a material to be processed by the main punch and retaining the moved slider by the position retaining portion; and [B] opening the upper die unit and the lower die unit by a predetermined amount from the closed state to release the slider retained by the position retaining portion, converting by the cam structure a movement of the slider in the predetermined sliding direction (S) by a biasing force of the biasing portion to a movement of the ejector in the work ejecting direction (E), and discharging the work punched out by the main punch and retained to the other die unit side by a friction force.

Embodiment

Hereinafter, one embodiment of the present invention will be described in detail with reference to the accompanying drawings. In this embodiment, a pressing machine is illustrated as a work manufacturing device according of the present invention.

(1) Configuration of a Pressing Machine

Figure 1:
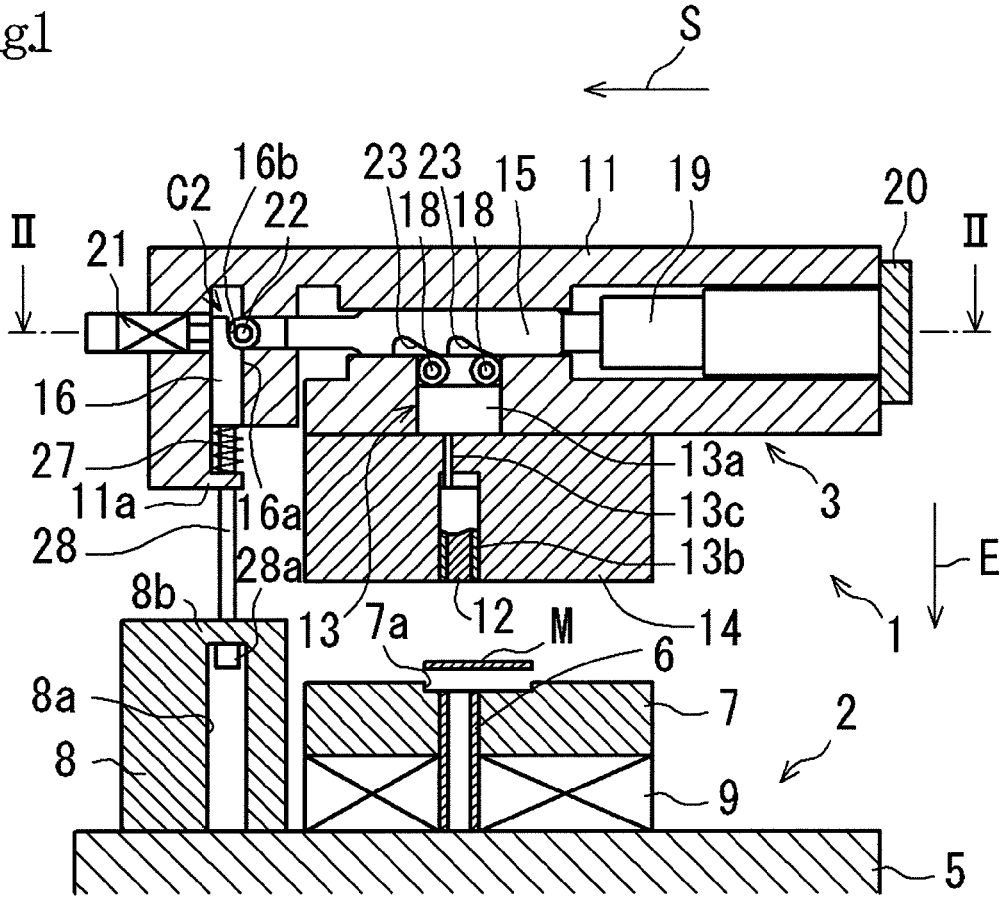
FIG. 1 is a longitudinal sectional view of a pressing machine according to an embodiment of the present invention, illustrating a state in which the die units are opened (a top dead center)

A pressing machine 1 according to the present embodiment includes a fixed lower die unit 2 (which is referred to as "one die unit" according to the present invention) and a movable upper die unit 3 opposite to the lower die unit 2 (which is referred to as "the other die unit" according to the present invention) as shown in FIG. 1. Between the upper die unit 3 and the lower die unit 2, a material to be processed M which is one of strip-shaped metal plates successively supplied in a predetermined direction (in a direction going from the front of the paper as you face FIG. 1 toward the back) is clamped. When the upper die unit 3 and the lower die unit 2 are closed, a work W having a predetermined shape is punched out from a material to be processed M by a main punch described later.

The lower die unit 2 essentially comprises a lower base 5, a main punch 6, a stripper 7 and a guide 8 (which is referred to as "a derestriction member" according to the present invention). The lower base 5 is a member that becomes a base fixed to the ground (not shown). The main punch 6 is integrally formed with the lower base 5 and is a member for punching out a work W from a material to be processed M.

On the top face of the stripper 7, a recess 7*a* is formed, on which a material to be processed is placed. The stripper 7 is disposed to the lower base 5 so as to be movable in a vertical direction and is movable relative to the main punch 6. In addition, the stripper 7 is biased upward by a first gas spring 9. The guide 8 is a member for restricting the range of vertical movement of a restriction member described later. The guide 8 is formed into a substantially inverted U shape, having a guide groove 8*a* and a top wall 8*b* on which the guide groove 8*a* is formed and is integrally formed with the lower base 5.

The upper die unit 3 essentially comprises an upper base 11, a subsidiary punch 12, an ejector 13, a die 14, a slider 15 and a restriction member 16. The upper base 11 is a member that becomes a base configured so as to move up and down against the ground by an elevating means (not shown). The subsidiary punch 12 is disposed integrally to the upper base 11. When the upper die unit 3 and the lower die unit 2 are closed, the subsidiary punch 12 punches a scrap M' (see FIG. 5) that is an unnecessary portion from the work W punched by the main punch 6. The upper base 11 generally comprises a number of members assembled.

Figure 2:
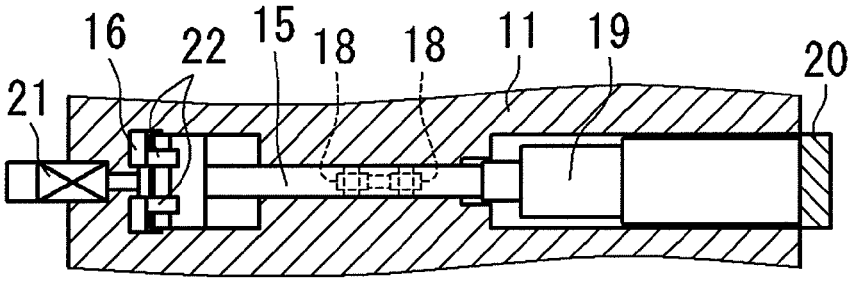
FIG. 2 is a cross-sectional view taken along line II-II in FIG. 1.

The ejector 13 is disposed to the upper base 11 so as to be movable in a vertical direction, and is movable relative to the subsidiary punch 12. The ejector 13 has a body 13*a*, a contact portion 13*b* that comes in directly contact with a work W and a rod 13*c* that communicates the body 13*a* to the contact portion 13*b*. On the top face of the body 13*a*, a plurality (two pieces, in the drawing) of rollers 18 which roll on the cam faces described later are rotatably disposed (see FIGS. 2 and 3). The contact portion 13*b* comes into contact with a portion of a material to be processed M that corresponds to a work W when a work W is punched out by the main punch 6. A subsidiary punch 12 is internally engaged in the contact portion 13*b*.

Figure 3A:
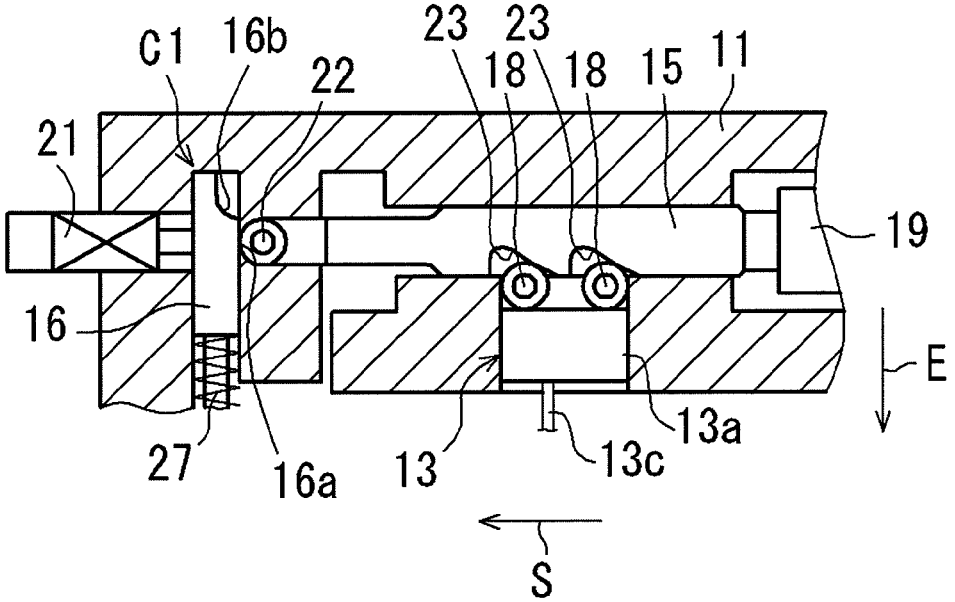

The ejector 13 is pushed upward (referred to as "in a direction opposite to a work ejecting direction" according to the present invention) by the work W punched out by the main punch 6 and retained on the upper die unit 3 side when the upper die unit 3 and the lower die unit 2 are closed (see FIG. 3A). On the other hand, when the upper die unit 3 and the lower die unit 2 are opened (referred to as "when the upper die unit and the lower die unit are opened by a predetermined amount from a closed state" according to the present invention), the ejector 13 is moved down in a direction E (referred to as "in a work ejecting direction" according to the present invention) to push down the work W retained on the upper die unit 3 side, thereby discharging the work W (see FIG. 3B).

The die 14 is a member for pressing down a portion that corresponds to the surrounding portion of a work W in a material to be processed M when the upper die unit 3 and the lower die unit 2 are closed and the work W is punched out from the material M by the main punch 6. The die 14 is disposed integrally to the upper base 11.

The slider 15 is disposed to the upper base 11 so as to be movable in a horizontal direction (referred to as "in a direction crossing with a vertical direction according to the present invention). To one end of the slider 15, a second gas spring 19 (referred to as "a biasing portion" according to the present invention) which biases the slider 15 in a predetermined sliding direction S is connected. The second gas spring 19 functions as a driving source for a movement of the slider 15 in the sliding direction S. Also, the second gas spring 19 is disposed on one lateral side of the upper base 11 and can be replaced or inspected without removing the upper die unit 3 from the pressing machine 1 if the cover material 20 is removed.

To the other end of the slider 15, a third gas spring 21 which biases the slider 15 in a direction opposite to the sliding direction S (referred to as "a biasing portion for buffering" according to the present invention) is connected. The third gas spring 21 functions so as to buffer a shock given at the slider moving end side by the second gas spring 19. Also, the third gas spring 21 is disposed on the other lateral side of the upper base 11 and can be replaced or inspected without removing the upper die unit 3 from the pressing machine 1. In addition, to the other end of the slider 15, a plurality (two pieces, in the drawing) of rollers 22 which are engaged with the restriction member 16 are rotatably disposed (see FIGS. 2 and 3).

Figure 3B:
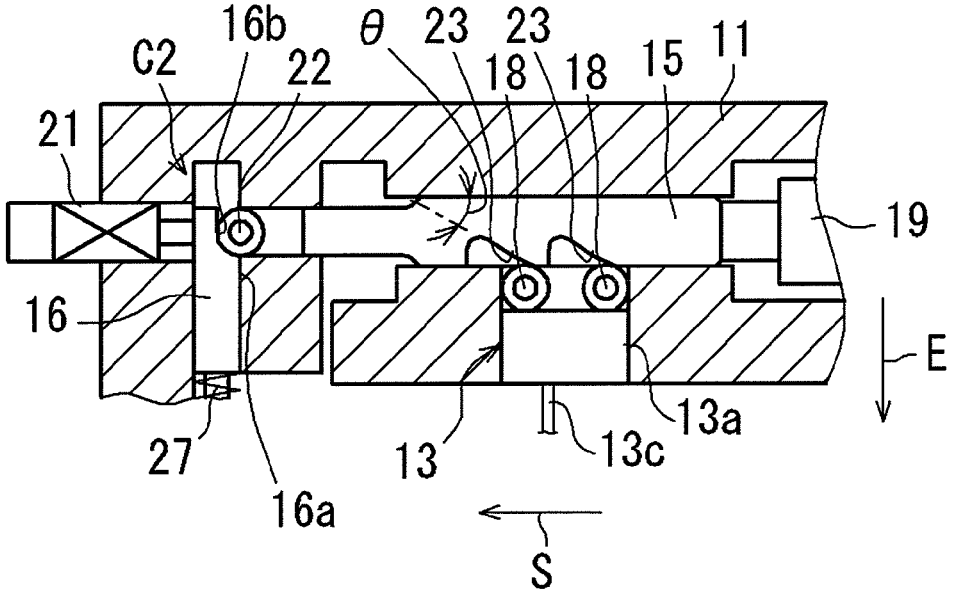

On the bottom face of the slider 15, as shown in FIG. 3, a plurality (two pieces, in the drawing) of cam faces 23 are formed, on each of which the plurality of rollers 18 roll, respectively. These cam faces 23 are inclined with a predetermined angle θ (30 degrees, for example) in the moving direction of the slider 15. Each of these rollers 18 rolls on the respective cam faces 23, thereby converting an upward movement of the ejector 13 to a movement of the slider 15 in a direction opposite to the sliding direction S when the upper die unit 3 and the lower die unit 2 are closed (see FIG. 3A). On the other hand, when the upper die unit 3 and the lower die unit 2 are opened, a movement of the slider 15 in a sliding direction S is converted to a movement of the ejector 13 in a downward direction E (see FIG. 3B). Thus, a "cam structure" according to the present invention is formed by the rollers 18 and the cam faces 23 according to the above embodiment.

On the top end side of the restriction member 16, there are formed a restriction face 16*a* that comes in contact with the rollers 22 of the slider 15 and a notch 16*b* into which the rollers 22 of the slider 15 get. The restriction member 16 is disposed to the upper base 11 so as to be movable in a vertical direction, which can move up and down between a control state C1 in which the rollers 22 of the slider 15 come into contact with the restriction face 16*a* to restrict a movement of the slider 15 in a predetermined sliding direction S and a non-control state C2 in which the rollers 22 of the slider 15 get into the notch 16*b* to allow a movement of the slider 15 in a predetermined sliding direction S. On the bottom end side of the restriction member 16, as shown in FIG. 1, a rod 28 into which a compression spring 27 (referred to as "a biasing portion for restriction" according to the present invention) is fit is installed. One end of the compression spring 27 is in contact with the lower end of the restriction member 16 and the other end is in contact with a supporting piece 11*a* which is integrally formed with the upper base 11. Therefore, the restriction member 16 is biased upward by the compression spring 27.

The distal end of the rod 28 is inserted in the guide groove 8*a* of the guide 8 in the lower die unit 2. To the distal end of the rod 28, a collar 28*a* which is lockable with the top wall 8*b* of the guide 8 is formed. The collar 28*a* is not engaged with the top wall 8*b* of the guide 8 until just before the upper die unit 3 and the lower die unit 2 are half opened (see FIG. 5) from the closed state (see FIG. 4), and the collar 28*a* is engaged with the top wall 8*b* of the guide 8 until just before the upper die unit 3 and the lower die unit 2 are fully opened (see FIG. 6) from the half opened state (see FIG. 5). While the collar 28*a* of the rod 28 and the top wall 8*b* of the guide 8 are not engaged, the restriction member 16 is in a control state C1 where it is biased upward by a biasing force of the compression spring 27. On the other hand, while the collar 28*a* of the rod 28 and the top wall 8*b* of the guide 8 are engaged, an upward movement of the restriction member 16 is restricted against a biasing force of the compression spring 27 and the restriction member 16 is in a non-control state C2 in which the upper die unit 3 and the lower die unit 2 are opened (see FIG. 6). Thus, a "position retaining portion" according to the present invention is formed by the restriction member 16, the compression spring 27 and the guide 8 according to the above embodiment.

(2) Operation of a Pressing Machine

Figure 4:
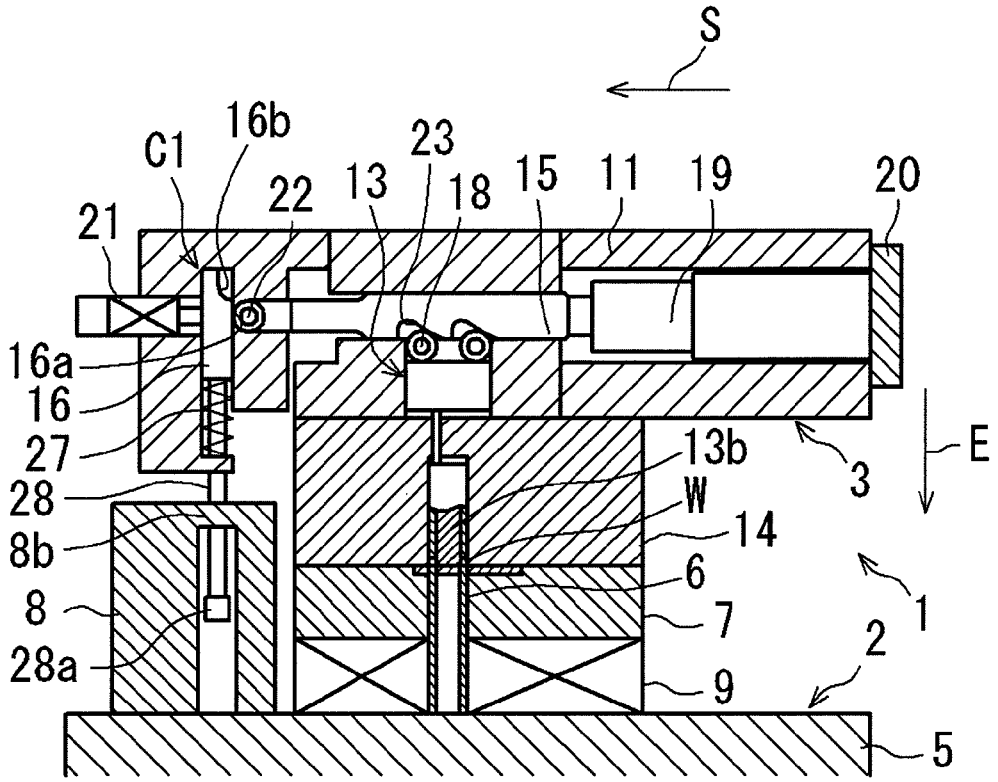
FIG. 4 is an operational view of the pressing machine shown in FIG. 1, illustrating a state in which the die units are closed (a bottom dead center)

Next, the operation of the pressing machine 1 having the above-mentioned configuration will be described. When a material to be processed M that was lifted up by a lifter (not shown) is conveyed between the upper die unit 3 and the lower die unit 2 which are opened (see FIG. 1), the upper die unit 3 is moved down toward the lower die unit 2. When the upper die unit 3 and the material M are brought into contact, the lifter is pushed downward and the material M is set in the recess 7*a* of the stripper 7. As the upper die unit 3 is moved down further, the die 14 and the subsidiary punch 12 apply more pressure to the material M. Then, as shown in FIG. 4, the upper die unit 3 and the lower die unit 2 are closed, and a work W is punched out from the material M by a reaction force from the main punch 6. At the same time, a scrap M' is punched out from the work W punched out by the subsidiary punch 12.

The work W punched out by the main punch 6 is fit into the die 14, the ejector 13 is moved up by a reaction force from the work W. Then, the rollers 18 of the ejector 13 roll on the cam faces 23 of the slider 15, and the slider 15 is moved in a direction opposite to a sliding direction S against a biasing force of the second gas spring 19. The work W fit into the die 14 is retained in the die 14 by a friction force generating between the inner circumference surface of the die 14 and the outer circumference surface of its own (work W), and the ejector 13 is retained in an elevated state by the retaining force of the work W.

As mentioned above, when the slider 15 is moved in a direction opposite to the sliding direction S, as shown in FIG. 3A, the rollers 22 of the slider 15 get out of the notch 16*b* of the restriction member 16. By a biasing force of the compression spring 27, however, the restriction member 16 moves up integrally with the upper die unit 3 to make a control state C1, and the rollers 22 of the slider 15 come in contact with the restriction face 16*a* of the restriction member 16. Therefore, the slider 15 is retained at one end in a direction opposite to the sliding direction S.

After that, as shown in FIG. 5, while the upper die unit 3 is moved up to half open the upper die unit 3 and the lower die unit 2, the collar 28*a* of the rod 28 is engaged with the top wall 8*b* of the guide 8 to restrict an upward movement of the restriction member 16 integrally with the upper die unit 3, and the restriction member 16 in a control state C1 is turned into a non-control state C2 against a biasing force of the compression spring 27.

After that, as shown in FIG. 6, when the upper die unit 3 is moved up further and the upper die unit 3 and the lower die unit 2 are fully opened, the restriction member 16 becomes in a non-control state C2. Then, as shown in FIG. 3B, the rollers 22 of the slider 15 get away from the restriction face 16*a* of the restriction member 16, the slider 15 is moved in a predetermined sliding direction S by a biasing force of the second gas spring 19, and the rollers 22 of the slider 15 get into the notch 16*b* of the restriction member 16. Thus, when the slider 15 is moved, the rollers 18 of the ejector 13 roll on the cam faces 23 of the slider 15, so that the ejector 13 is moved down, the work W retained by the die 14 is pushed out by the ejector 13, drops down and is discharged. A shock at the moving end of the slider 15 is buffered by a biasing force of the third gas spring 21. The discharged work W is collected with precise timing of its dropping by a work ejection shovel (not shown) which is a known means.

(3) Effects of the Embodiment

As described above, in this embodiment, the ejector 13 discharges a work W when the upper die unit 3 and the lower die unit 2 are opened. Therefore, the work W punched out by the main punch 6 is prevented from being pushed back to a material to be processed M at the same time of the die opening. In addition, the rollers 18 of the ejector 13 roll on the cam faces 23 of the slider 15, thereby converting an upward movement of the ejector 13 to a movement of the slider 15 when the upper die unit 3 and the lower die unit 2 are closed and converting a movement of the slider 15 to a downward movement of the ejector 13 when the upper die unit 3 and the lower die unit 2 are opened. Therefore, the second gas spring 19 which is a drive source of the ejector 13 can be disposed along a horizontal direction, preventing an increase of the size of a die structure in a height direction. Especially, even if there is a dimensional restriction in a height direction of a die structure, a second gas spring 19 which has a larger height dimension (that is, a larger biasing force) can be adopted, leading to a higher flexibility in selection of a second gas spring 19. In addition, a second gas spring 19 can be disposed on a lateral side end of a die unit. As a result, the second gas spring 19 can be easily replaced or inspected without removing an upper die unit 3 or a lower die unit 2 from the pressing machine 1. Compared to a device which uses a known hydraulic mechanism to discharge a work W, the work W ejecting speed is necessarily increased, as the work W punching-out speed is increased, leading to an improvement of production efficiency of a work W. In addition, every time the upper die unit 3 and the lower die unit 2 are opened, a work W can be discharged reliably. Further, variations in the production accuracy of works W can be reduced.

In this embodiment, a third gas spring 21 is connected to one end of the slider 15 in a predetermined sliding direction S, and the third gas spring 21 can absorb a shock at the moving end of the slider 15 when a work is discharged. Therefore, even if the ejecting speed of a work W is increased, a shock can be absorbed reliably. In addition, a third gas spring 21 can be disposed along a horizontal direction, preventing an increase of the size of a die structure in a height direction.

In this embodiment, a cam structure is adopted, which includes cam faces 23 disposed in the slider 15 and inclined in a predetermined sliding direction S of the slider 15 and rollers 18 disposed rotatably in the ejector 13 so as to roll on the cam faces 23. Therefore, the rollers 18 of the ejector 13 roll on the cam faces 23 of the slider 15, leading to a more smooth conversion of an up and down movement of the ejector 13 to a horizontal movement of the slider 15 and vice versa.

In addition, in this embodiment, a position retaining portion is adopted, which includes a restriction member 16, a compression spring 27 and a guide 8. Therefore, until just before the upper die unit 3 and the lower die unit 2 are opened from a closed state, a movement of the slider 15 in a sliding direction S is restricted by the restriction member 16 which is in a control state C1. When the upper die unit 3 and the lower die unit 2 are opened, the guide 8 and the rod 28 are engaged, thereby turning the restriction member 16 into a non-control state C2 and derestricting a movement of the slider 15 in a predetermined sliding direction S. Therefore, the position retaining and releasing of the slider 15 and the ejector 13 can be performed more reliably.

Further, in this embodiment, a main punch 6 is disposed in the lower die unit 2, and an ejector 13 is disposed in the upper die unit 3. When the upper die unit 3 and the lower die unit 2 are closed, a work W punched out by the main punch 6 is retained on the upper die unit 3 side. When the upper die unit 3 and the lower die unit 2 are opened, the work W drops down and is discharged by the ejector 13. Therefore, compared to a pressing machine in which the work retained in the lower die unit is lifted up and discharged, production efficiency of a work W is enhanced. Also, between the upper die unit 3 and the lower die unit 2, a relatively large space that does not interfere with a material to be processed M can be used as an ejection space of the work W.

The present invention is not limited to the above embodiment, and depending on the purpose and usage, various modifications can be made without departing from the spirit and scope of the invention. Specifically, in this embodiment, a main punch 6 is disposed in a lower die unit 2, and an ejector 13, a slider 15 and a second gas spring 19 are disposed in an upper die unit 3. But the present invention is not limited to this, and a main punch 6 may be disposed in an upper die unit 3, and an ejector 13, a slider 15 and a second gas spring 19 may be disposed in a lower die unit 2. In this case, the ejector 13 moves up and a work W is lifted and discharged.

In this embodiment, when the upper die unit 3 and the lower die unit 2 are opened, the ejector 13 discharges a work W. But the present invention is not limited to this configuration, and it may be configured so that the ejector 13 discharges a work W when the upper die unit 3 and the lower die unit 2 are half closed and opened.

In this embodiment, the slider 15 moves in a horizontal direction. But the present invention is not limited to this configuration, and it may be configured so that the slider 15 is moved in a direction inclined by a predetermined angle from a horizontal direction. In the above embodiment, the restriction member is moved in a vertical direction. But the present invention is not limited to this configuration, and it may be configured so that the restriction member is moved in a horizontal direction.

In this embodiment, the restriction member 16 is engaged with the slider 15 to directly retain the slider 15 in a position. But the present invention is not limited to this configuration, and it may be configured so that the restriction member 16 is engaged with the ejector 13 to indirectly retain the slider 15 in a position.

In this embodiment, a cam structure is adopted, in which cam faces 23 are disposed in the slider 15 and rollers 18 which roll on the cam face 23 are disposed in the ejector 13. But the present invention is not limited to this configuration, and for example, a cam structure in which cam faces 23 are disposed in the ejector 13 and rollers 18 which roll on the cam face 23 are disposed in the slider 15 may be adopted, or a cam structure in which a first inclined face is disposed in the slider 15 and a second inclined face which is in contact with the first inclined face is disposed in the ejector 13 may be adopted.

Further, in this embodiment, a pressing machine 1 in which an upper die unit 3 is movable and a lower die unit 2 is fixed is described as an example. But the present invention is not limited to this configuration, and as an example, a pressing machine in which an upper die unit is fixed and a lower die unit is movable may be adopted, or as another example, a pressing machine in which an upper die unit and a lower die unit are movable may be adopted.

The present invention can be widely used as the art of manufacturing a work, which includes a step of discharging the work punched out by a main punch using an ejector.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above-described embodiments, and various variations and modifications may be possible without departing from the scope of the present invention.

What is claimed is:

1. A work manufacturing device comprising:

an upper die unit; and a lower die unit disposed opposite to the upper die unit, wherein one of the upper die unit and the lower die unit includes a main punch for punching out a work from a material to be processed, and the other die unit includes:

an ejector disposed so as to be movable in a vertical direction and to discharge the work punched out by the main punch and retained with the other die unit;

a slider disposed so as to be movable in a direction crossing the vertical direction;

a biasing portion connected to the slider and biasing the slider in a predetermined sliding direction; and a cam structure defined between the ejector and a portion of the slider, wherein the cam structure converts a movement of the ejector in a direction opposite to a work ejecting direction to a movement of the slider in a direction opposite to the predetermined sliding direction against a biasing force of the biasing portion when the upper die unit and the lower die unit are closed, and wherein the cam structure converts a movement of the slider in the predetermined sliding direction by the biasing force of the biasing portion to a movement of the ejector in the work ejecting direction when the upper die unit and the lower die unit are opened by a predetermined amount from the closed state, the work manufacturing device further comprising:

a position retaining portion which retains the slider having been moved in the direction opposite to the predetermined sliding direction, in a retained position for a certain period of time until the upper die unit and the lower die unit are opened by the predetermined amount from the closed state.

2. The work manufacturing device according to claim 1, wherein a biasing device for buffering that biases the slider in the direction opposite to the predetermined sliding direction and is connected to one end of the slider in the predetermined sliding direction.

3. The work manufacturing device according to claim 2, wherein the cam structure includes:

a cam face disposed in the slider and inclined in the predetermined sliding direction of the slider; and a roller which is rotatably disposed in the ejector so as to roll on the cam face.

4. The work manufacturing device according to claim 2, wherein the position retaining portion includes:

a restriction member provided in the other die unit so as to be movable between a control state in which a movement of the slider in the predetermined sliding direction is restricted and a non-control state in which a movement of the slider in the predetermined sliding direction is derestricted;

a biasing device for restriction which biases the restriction member toward the control state; and a derestriction member which moves the restriction member against a biasing force of the biasing device for restriction from the control state to the non-control state when the upper die unit and the lower die unit are opened by the predetermined amount from the closed state.

5. The work manufacturing device according to claim 2, wherein the one die unit is the lower die unit and the other die unit is the upper die unit.

6. The work manufacturing device according to claim 1, wherein the cam structure includes:

a cam face disposed in the slider and inclined in the predetermined sliding direction of the slider; and a roller which is rotatably disposed in the ejector so as to roll on the cam face.

7. The work manufacturing device according to claim 1, wherein the position retaining portion includes:

a restriction member provided in the other die unit so as to be movable between a control state in which a movement of the slider in the predetermined sliding direction is restricted and a non-control state in which a movement of the slider in the predetermined sliding direction is derestricted;

a biasing device for restriction which biases the restriction member toward the control state; and a derestriction member which moves the restriction member against a biasing force of the biasing device for restriction from the control state to the non-control state when the upper die unit and the lower die unit are opened by the predetermined amount from the closed state.

8. The work manufacturing device according to claim 1, wherein the one die unit is the lower die unit and the other die unit is the upper die unit.

9. A method for manufacturing a work using the work manufacturing device according to claim 1, comprising:

converting, by the cam structure, a movement of the ejector in the direction opposite to the work ejecting direction to the movement of the slider in the direction opposite to the predetermined sliding direction against the biasing force of the biasing portion when the upper die unit and the lower die unit are closed to punch out the work from the material to be processed by the main punch;

retaining the moved slider by the position retaining portion;

opening the upper die unit and the lower die unit by the predetermined amount from the closed state to release the slider retained by the position retaining portion;

converting by the cam structure the movement of the slider in the predetermined sliding direction by the biasing force of the biasing portion to the movement of the ejector in the work ejecting direction; and discharging the work punched out by the main punch and retained with the other die unit by a friction force.

* * * * *